United States Patent [19]

Lorieux

[11] Patent Number: 4,970,887

[45] Date of Patent: Nov. 20, 1990

[54] METHOD AND APPARATUS FOR UPSETTING FORGED BARS

[75] Inventor: Henri A. G. Lorieux, Sannois, France

[73] Assignee: Societe Nationale d'Etude et de Construction de Moteurs d'Aviation "S.N.E.C.M.A.", Paris, France

[21] Appl. No.: 305,178

[22] Filed: Feb. 2, 1989

[30] Foreign Application Priority Data

Feb. 3, 1988 [FR] France ..... 88 01227

[51] Int. Cl.[5] ..... B21K 3/04

[52] U.S. Cl. ..... 72/356; 72/377

[58] Field of Search ..... 72/306, 356, 377; 10/24; 29/156.8 B

[56] References Cited

U.S. PATENT DOCUMENTS

| | | | |
|---|---|---|---|
| 3,154,849 | 11/1964 | Dolch, Jr. | 29/156.8 B |
| 3,392,569 | 7/1968 | Ruoff et al. | 72/377 |
| 3,641,801 | 2/1972 | Lachaussee et al. | 72/377 |
| 4,484,464 | 11/1874 | Nihei et al. . | |

FOREIGN PATENT DOCUMENTS

| | | |
|---|---|---|
| 2050483 | 4/1971 | France . |
| 2050489 | 4/1971 | France . |
| 2220328 | 10/1974 | France . |
| 2494606 | 5/1982 | France . |
| 61-193739 | 8/1986 | Japan . |
| 183026 | 7/1966 | U.S.S.R. . |
| 804163 | 2/1981 | U.S.S.R. . |
| 821016 | 4/1981 | U.S.S.R. . |

*Primary Examiner*—Lowell A. Larson

*Attorney, Agent, or Firm*—Bacon & Thomas

[57] ABSTRACT

A method and apparatus for upsetting forged bars to form compressor vane blanks are disclosed which utilize a two-stage upsetting process. In a first stage, the rough forged bar is placed in a first die having a first enlarged cross sectional area such that the end of the bar to be upset extends into the enlarged cross sectional area of the die. The enlarged cross sectional area is shaped so as to have at least three lines of contact with the bar segment during lateral expansion of the bar. In a second upsetting stage, the expanded bar is removed from the first die and inserted into a second die, also defining an enlarged cross sectional area portion such that the expanded portion of the bar extends into the enlarged cross sectional area of the second die. The second enlarged cross sectional area has a cross sectional shape so as to accommodate the previously enlarged portion of the bar such that at least one line of contact is maintained between the bar and the die as the bar laterally expands.

8 Claims, 3 Drawing Sheets

METHOD AND APPARATUS FOR UPSETTING FORGED BARS

BACKGROUND OF THE INVENTION

The present invention relates to a method and apparatus for upsetting and end portion of a rough forged bar to form a blank from which a turbojet engine compressor vane may be manufactured.

Turbojet engine compressor vane blanks have been manufactured by upsetting the end of a cylindrical bar to increase the cross sectional area of the bar to a required volume of material to make the root of the compressor vane. Limits on the upsetting procedure can be defined by two kinds of parameters:

(a) Technical parameters, such as the upsetting ratio t defined by $t=(L_0-L_0)/D_0$ wherein $L_0$ is the initial length of the portion of the bar being upset, $L_1$ is the length of the bar portion after upsetting and $D_0$ is the initial diameter of the bar being upset. $L_0-L_1$ is the effective path of the forge punch being used, the upper limit of this path being a design feature of a particular forge; and, (b) Metallurgical parameters such as the reduction ratio r defined by $r=L_0/L_1=S_1/S_0=(D_1/D_0)^2$ in which $S_0$ is the initial cross sectional area of the bar, $S_1$ is the final cross section of the bar following the upsetting procedure and $D_1$ is the corresponding diameter.

Geometric restrictions have been placed on the known upsetting methods to avoid unacceptable defects in the formed blanks. The defects are caused by inadequate control of the bar deformation during the upsetting process and typically consist of folds which may be caused by buckling of the bar segment or improper fiber orientation due to the twisting of the bar after buckling. The defects imposed upon the bar by the known methods are illustrated in FIGS. 1*a*, 1*b*, 1*c* and 1*d*. In these figures, a bar B is placed in a die A to upset an end portion of the bar in a 4-step operation. The individual steps are represented by the figures and result in length reductions $l_1$, $l_2$, $l_3$ and $l_4$. The bar B may buckle and then twist during the length reductions leading to the known defects noted above.

It is conventionally thought that, in order to avoid these defects, upper limits must be placed on the upsetting ratio and the reduction ratio. Generally, an upper limit of 4 has been placed on the upsetting ratio t in regard to a single operation upsetting method, or an upper limit of 6 when a 2-step upsetting method is utilized. An upper limit of the reduction ratio r of between 1.5 and 2 has been used, depending upon the type of alloy of the bar.

Various attempts have been made to exceed these upper limits without forming the aforementioned defects. Upsetting has been carried out by a tool nutating on the bar end in which the bar is simultaneously displaced toward the work zone by a length corresponding to the volume to be formed. Also, upsetting in several passes has been attempted by advancing the bar at each pass by the length related to the volume to be formed. Such typical examples of these methods can be found in French patents Nos. 2,050,483; 2,050,484; and 2,220,328. While these procedures have been an improvement, they have not satisfactorily eliminated the known defects, in particular, the fiber orientation has proven to be unreliable.

SUMMARY OF THE INVENTION

A method and apparatus for upsetting forged bars to form compressor vane blanks are disclosed which utilize a two-stage upsetting process. In a first stage, the rough forged bar is placed in a first die having a first enlarged cross sectional area such that the end of the bar to be upset extends into the enlarged cross sectional area of the die. The enlarged cross sectional area is shaped so as to have at least three lines of contact with the bar segment during lateral expansion of the bar. A punch is brought into contact with the end of the bar and exerts a substantially axial force thereon sufficient to cause the end portion to decrease in length and to laterally expand so as to substantially fill the enlarged cross sectional area of the die.

In a second upsetting stage, the expanded bar is removed from the first die and inserted into a second die, also defining an enlarged cross sectional area portion such that the expanded portion of the bar extends into the enlarged cross sectional area of the second die. The second enlarged cross sectional area has a cross sectional shape so as to accommodate the previously enlarged portion of the bar such that at least one line of contact is made between the bar and the die as the bar laterally expands. Again, a punch exerts a substantially axial force on the end of the bar to cause it to again decrease in length and to laterally expand so as to substantially fill the enlarged cross sectional area of the second die.

The cross section of the enlarged cross sectional area of the first die may have a generally cruciform shape such that it contacts the bar along four lines of contact during the bars lateral expansion, the lines of contact being circumferentially displaced around the bar approximately 90° from each other.

The cross section of the second enlarged cross sectional area of the second die may assume either a parallelogram or a generally circular shape. In either case, the dimensions are such that the cruciform shape formed on the bar after the first upsetting stage is accommodated within the parallelogram or the circular cross section. The second die contacts the bar at the outermost portions of the cruciform cross sectional shape to form lines of contact during the second lateral expansion of the bar end to prevent the bar from buckling or twisting.

It has been found that, with some titanium alloys, upsetting ratios t of 8–10 have been achieved in the two-stage method according to the invention, which required at least five stages according to the known methods. Depending upon the particular alloys utilized and the quality criteria desired, higher upsetting ratios can be achieved with the method and apparatus according to the invention than with the known prior art. Metalographic testing on the forgings made by the apparatus and method according to the invention demonstrate clear improvement in the fiber orientation relative to the known methods and the absence of known defects.

The improvements are believed to result from the bar resting against at least three lines of contact with the die during the first stage, thereby avoiding any deformation by buckling, since the metal of the bar can flow only in the direction that the die allows. This also prevents any twisting of the bar during the upsetting process. Again, during the second stage of the method according to the invention, the contact maintained between the laterally expanded portions of the bar and the die also prevents any deformation by buckling or twisting.

DETAILED DESCRIPTION OF THE PREFERRED EMBODIMENTS

Figures 1A, 1B, 1C, 1D:
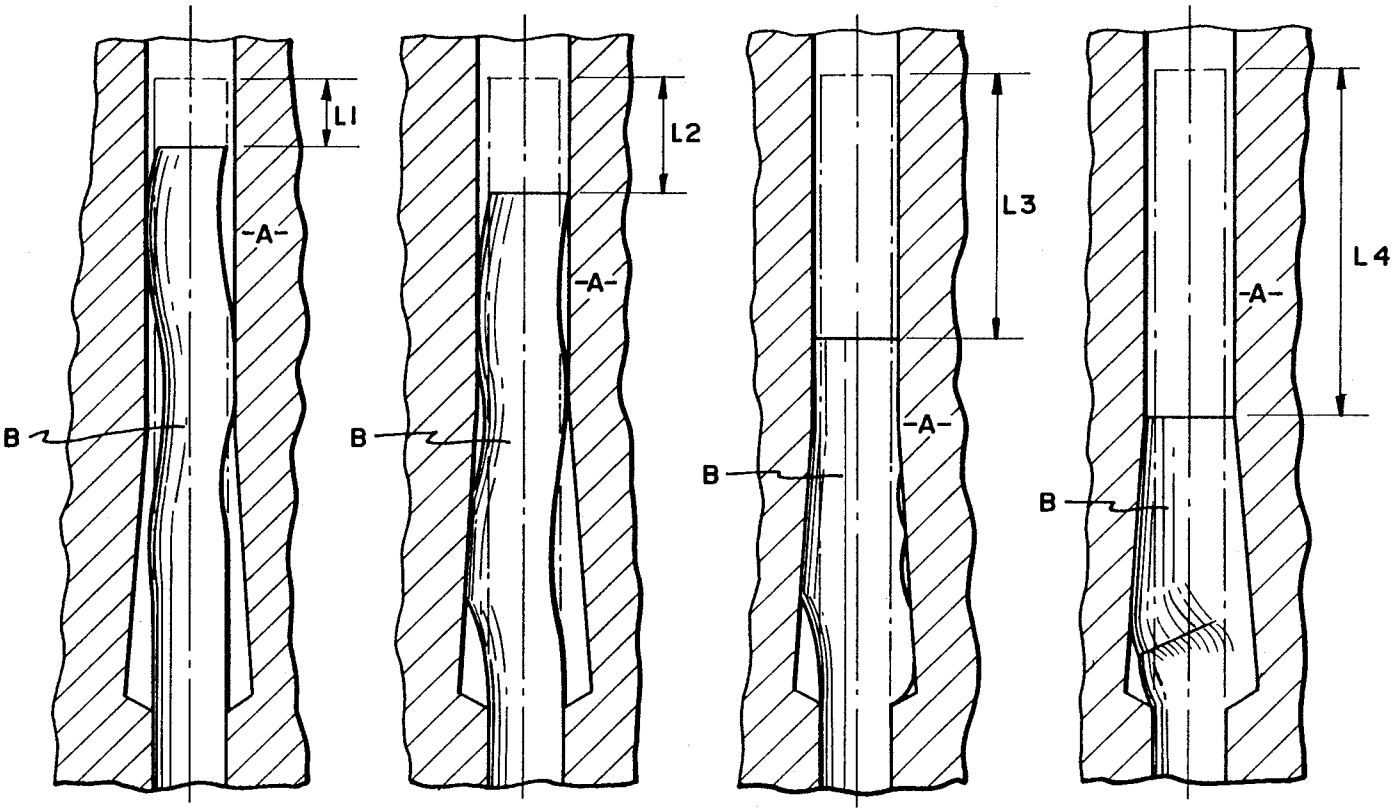
FIG. 1a PRIOR ART
FIG. 1b PRIOR ART
FIG. 1c PRIOR ART
FIG. 1d PRIOR ART
FIGS. 1*a*–1*d* are partial, cross sectional views illustrating four consecutive steps of a known upsetting method.
Figure 2A:
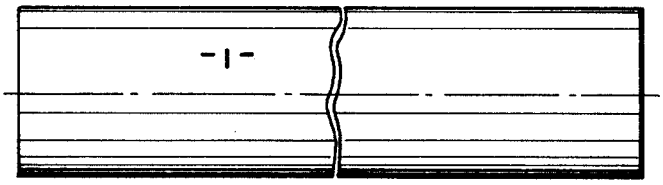
FIG. 2*a* is a side view of a bar prior to its upsetting.
Figure 2B:
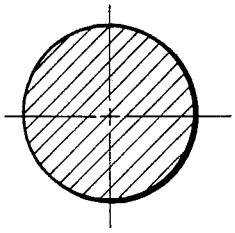
FIG. 2*b* is a transverse cross sectional view of the bar shown in FIG. 2*a*.
Figure 3A:
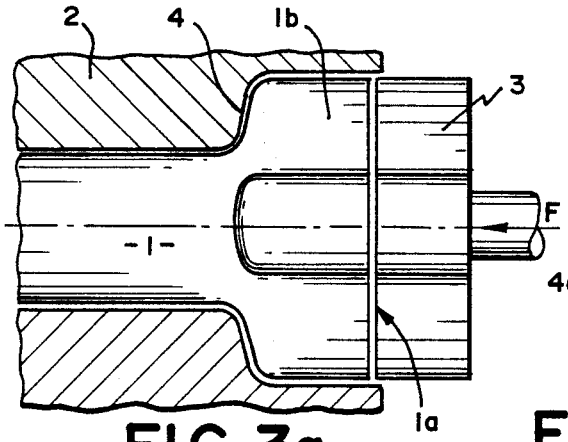
FIG. 3*a* is a partial, axial cross sectional view of the bar and the die during the first upsetting stage according to the invention.
Figure 3B:
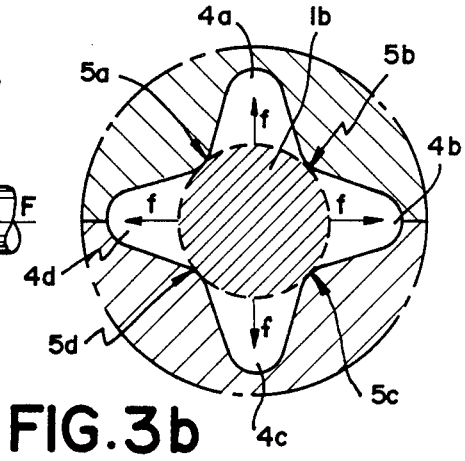
FIG. 3*b* is a transverse cross sectional view of the apparatus shown in FIG. 3*a*.

The method and apparatus according to the invention will be described in conjunction with a generally cylindrical bar 1 having a circular cross section illustrated in FIGS. 2*a* and 2*b*, although it will be understood that bars of other cross sectional shapes may be utilized without exceeding the scope of this invention. As illustrated in FIGS. 3*a* and 3*b*, the bar 1 is placed in a first die 2 rigidly attached to a known forging press or upsetting machine in known fashion. The end portion 1*b* of the bar to be upset extends into an enlarged cross sectional area portion 4 defined by the die 2. A punch 3 of the known forging press or upsetting machine exerts a substantially axial force onto the end 1*a* of the bar to cause the end portion lb to decrease in length and to laterally expand to substantially fill the cavity 4 defined by the die 2.

The enlarged area portion 4 of the die 2 may assume a generally cruciform cross sectional shape, as illustrated in FIG. 3*b*. The cruciform shape comprises radial lobes 4*a*, 4*b*, 4*c* and 4*d* arranged symmetrically about the central axis of the die 2. The cruciform shape also generates lines 5*a*, 5*b*, 5*c* and 5*d* which contact the outer surface of the bar 1 as it laterally deforms into the lobes of the enlarged cross sectional area 4. The four lines of contact are circumferentially distributed about the bar and are displaced approximately 90° from each other. The lines of contact between the die 2 and the bar 1 maintain permanent contact between these elements during the upsetting stage. The lines of contact between the die and the bar are necessary at the moment the irreversible defects of buckling or twisting normally appear during the process. This contact may be maintained from the beginning of the operation, although as a practical matter, it is often easier to provide a certain radial clearance at the initial stage of the process on the order of 0.5 mm. The punch 3 exerts a substantially axial force in the direction of arrow F on the end 1*a* of the bar 1 to thereby cause the metal of the bar to flow in the directions of arrows f into the lobes of the enlarged cross sectional area portion 4 of the die 2.

Figure 4A:
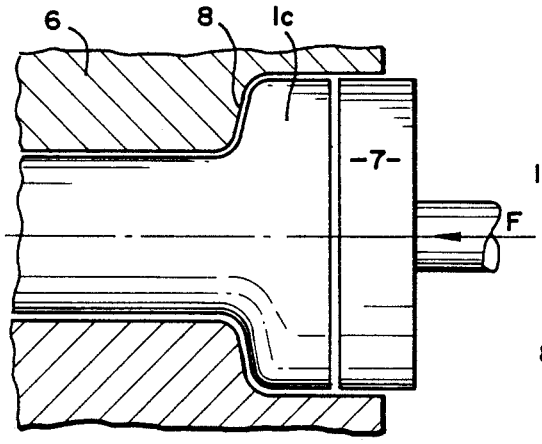
FIG. 4*a* is a longitudinal cross sectional view of the apparatus according to the invention during the second upsetting stage.
Figure 4B:
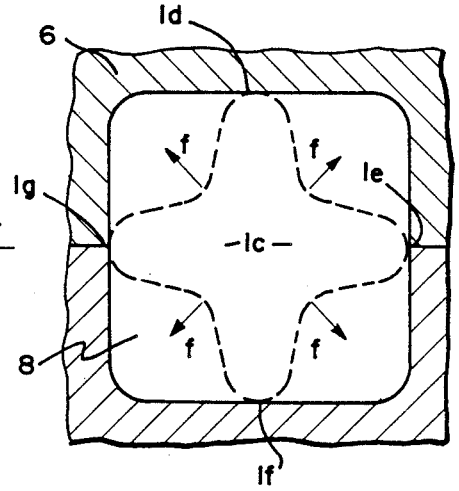
FIG. 4*b* is a transverse cross sectional view of the apparatus shown in FIG. 4*a*.

The intermediate forged bar 1*c* is removed from die 2 and is placed into a second die 6, as illustrated in FIGS. 4*a* and 4*b*. The second die 6 has a second enlarged area portion 8 which may assume a generally parallelogram cross sectional shape of a square having rounded corners as illustrated in FIG. 4*b*. The lateral dimensions of the enlarged cross sectional area are such that it accommodates the generally cruciform shape of the intermediate forged bar 1*c* such that the apexes of the cruciform shape form lines of contact with the inner surface of the enlarged cross sectional area portion 8. A punch 7 exerts a substantially axial force in the direction of arrow F on the end of the intermediate forged bar 1*c* to again cause the length of the end portion to decrease and to cause the lateral expansion of the end portion so as to substantially fill the second enlarged cross sectional area portion 8. The apexes 1*d*, 1*e*, 1*f* and 1*g* contact the side of enlarged cross sectional area 8 to prevent any buckling or twisting of the bar during the upsetting process. The intermediate bar 1*c* expands laterally in the direction of arrows f, illustrated in FIG. 4*b* to fill the cavity 8. Contact between the apexes and the die are continuously maintained during the second stage deformation process, although an initial clearance of approximately 0.5 mm may be provided.

Figure 5:
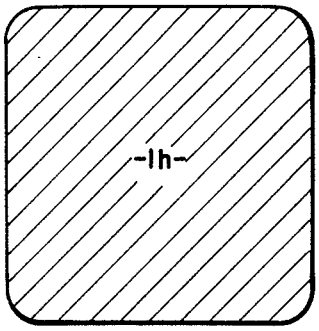
FIG. 5 is a cross sectional view of the upset portion of the finished blank.

At the end of the second stage, the upset end portion of the bar assumes the cross sectional shape 1*h* as illustrated in FIG. 5. This upset portion of the bar may form the root of a forged turbojet engine compressor vane.

Figure 6:
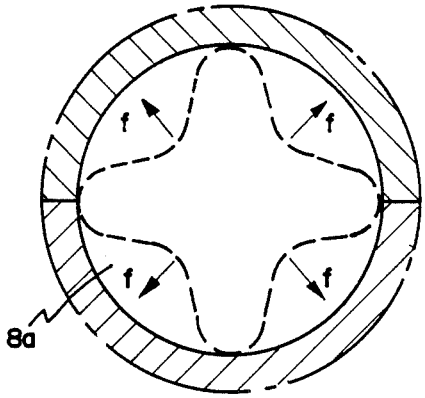
FIG. 6 is a partial, transverse cross sectional view of a second embodiment of the enlarged portion of the second die similar to that shown in FIG. 4*b*.

Although the invention has been described as a two-stage process, quite obviously a different number of upsetting stages may be utilized, depending upon the alloys being formed, the parts to be made and the upsetting ratio desired. The enlarged cross sectional area portions of the first and second dies may assume different shapes as long as continuous contact between the die and the bar can be made along several lines of contact. The enlarged cross sectional area of the second die 6 may be generally circular in configuration to define a cavity 8*a*, as illustrated in FIG. 6. As in the previously described embodiment, the apexes of the generally cruciform shaped bar end portion contact the interior surface of the cavity 8*a* during the deformation process to prevent bending or twisting of the bar.

Figure 7A:
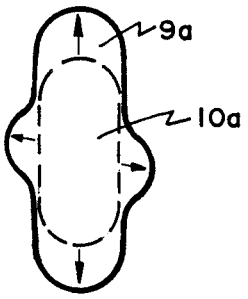
FIGS. 7*a*–7*c* are schematic illustrations of alternate enlarged die cross sectional area shapes which may be utilized with bars having a non-circular cross sections.
Figure 7B:
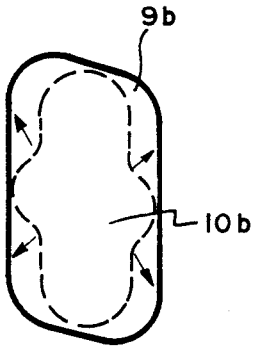
Figure 7C:
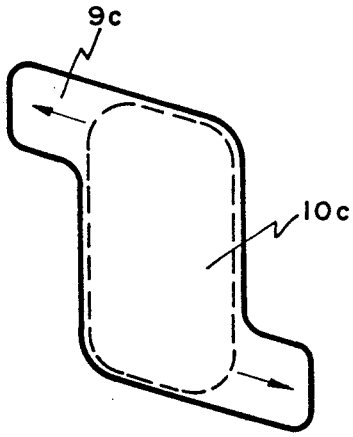

FIGS. 7*a*, 7*b* and 7*c* schematically illustrate other shapes of enlarged cross sectional area cavities 9*a*, 9*b* and 9*c* which may be associated with the end portions of bars having cross sectional shapes 10*a*, 10*b* and 10*c*, respectively. These non-circular bar cross sections may be more suitable for the desired shape of the final parts.

The foregoing description is provided for illustrative purposes only and should not be construed as in any way limiting this invention, the scope of which is defined solely by the appended claims.

I claim:

1. A method of upsetting an end portion of a rough forged bar to form a turbine blade/vane root blank, the end portion having an initial length $L_0$ and an initial cross-sectional area of $S_0$ to an end portion having a final length of $L_1$ and final cross-sectional area of $S_1$ such that $L_0 > L_1$ and $S_0 < S_1$ comprising the steps of:

(a) placing the bar into a first die having a portion with a first enlarged cross-sectional area having a generally cruciform configuration such that the end portion of the bar extends into the first enlarged cross-sectional area of the die;

(b) exerting a substantially axial first force on the end portion of the bar to cause the end portion to decrease in length and to laterally expand to substantially fill the first enlarged cross-section of the first die and assume a generally cruciform cross-sectional configuration;

(c) maintaining at least four lines of contact between the enlarged cross-sectional portion of the first die and the end portion of the bar such that the lines of contact are displaced approximately 90° from each other around the circumference of the bar during lateral expansion of the end portion;

(d) removing the bar from the first die;

(e) placing the bar into a second die having a potion with a second enlarged cross-sectional area such that the end portion of the bar extends into the second enlarged cross-sectional area;

(f) exerting a substantially axial second force on the end portion of the bar to cause the end portion to decrease in length and to laterally expand to substantially fill the second enlarged cross-section of the second die; and, (g) maintaining at least one line of contact between the second enlarged cross-section of the second die and the end portion of the bar during lateral expansion of the end portion such that the maximum upsetting ratio (t max) is at least 8 wherein:

$$t = \frac{L_0 - L_1}{D_0}$$

$L_0$=initial length of the end portion of the bar;
$L_1$=final length of the end portion of the bar;
$D_0$=initial diameter of the end portion of the bar.

2. The method according to claim 1 further comprising the step of forming the second enlarged cross-sectional area in a generally parallelogram configuration.

3. The method according to claim 2 wherein the second enlarged cross-sectional area has a generally square cross-sectional configuration with rounded corners.

4. The method according to claim 1 further comprising the step of forming the second enlarged cross-sectional area in a generally circular configuration.

5. Apparatus for upsetting an end portion of a rough forged bar to form a turbine vane/blade root blank, the end portion having an initial length $L_0$ and an initial cross-sectional area of $S_0$ to an end portion having a final length of $L_1$ and final cross-sectional area of $S_1$ such that $L_0 > L_1$ and $S_0 < S_1$ comprising:

(a) a first die having a first enlarged cross-sectional area portion with a generally cruciform configuration to accommodate the bar therein such that the end portion of the bar extends into the enlarged cross-sectional area portion, the first die having elements defining at least four contact lines circumferentially displaced approximately 90° from each other to contact the bar during lateral expansion;

(b) means to exert a first substantially axial force on the end portion of the bar of sufficient magnitude to cause the end portion to decrease in length and to laterally expand to substantially fill the first enlarged cross-sectional area portion of the first die and assume a generally cruciform cross-sectional configuration;

(c) a second die having a second enlarged cross-sectional area portion to accommodate the bar therein such that the laterally expanded generally cruciform end portion extends into the enlarged cross-sectional area portion, so as to maintain at least one line of contact during further lateral expansion of the end portion; and, (d) means to exert a second substantially axial force on the end portion of the bar of sufficient magnitude to cause the end portion to decrease in length and to laterally expand to substantially fill the second enlarged cross-sectional area portion of the second die such that the maximum upsetting ration (t max) is at least 8 wherein:

$$t = \frac{L_0 - L_1}{D_0}$$

$L_0$=initial length of the end portion of the bar;
$L_1$=final length of the end portion of the bar;
$D_0$=initial diameter of the end portion of the bar.

6. Apparatus according to claim 5 wherein the second enlarged cross-sectional area portion has a generally parallelogram configuration.

7. Apparatus according to claim 6 wherein the second enlarged cross-sectional area portion has a generally square configuration with rounded corners.

8. Apparatus according to claim 5 wherein the second enlarged cross-sectional area portion has a generally circular configuration.

* * * * *